United States Patent [19]

Desjardins

[11] 4,247,020

[45] Jan. 27, 1981

[54] LIQUID CONTAINING AND DISPENSING DEVICE

[76] Inventor: Bernard Desjardins, 1 Parent St., Port Cartier, Canada, G5B 2E6

[21] Appl. No.: 9,453

[22] Filed: Feb. 5, 1979

[30] Foreign Application Priority Data

Feb. 9, 1978 [GB] United Kingdom ..... 05196/78

[51] Int. Cl.[3] ..... B67B 7/28

[52] U.S. Cl. ..... 222/83.5; 222/88; 222/105; 222/183

[58] Field of Search ..... 222/83, 83.5, 89, 81, 222/85, 86, 88, 80, 105, 107, 94

[56] References Cited

U.S. PATENT DOCUMENTS

| | | | |
|---|---|---|---|
| 3,809,290 | 5/1974 | Schmit | 222/88 |
| 3,938,707 | 2/1976 | Schmit | 222/83.5 |
| 4,057,175 | 11/1977 | Kessler | 222/86 |

*Primary Examiner*—Allen N. Knowles

[57] ABSTRACT

A liquid containing and dispensing device is disclosed. The device comprises a rigid wall container adapted to receive a sealed liquid containing pouch having flexible walls in close contact with the walls of the container, and a pouring spout having a tubular depending portion with a sharpened end slidably mounted in the container and adapted to perforate the top of the pouch and form a seal around the opening in the pouch to effect pouring of the contents of the pouch.

4 Claims, 8 Drawing Figures

LIQUID CONTAINING AND DISPENSING DEVICE

This invention relates to a liquid containing and dispensing device and, more particularly, to a dispensing means mounted on such device for easily perforating liquid containing pouches and pouring liquid from such pouches.

It is commonly known to package liquids in pouches which are made of flexible plastic material and inserted in rigid wall containers for pouring the content thereof. These pouches are normally opened by cutting a corner thereof with a pair of scissors or with a sharp knife. A liquid containing and dispensing device with a pouch piercing arrangement is disclosed in U.S. Pat. No. 3,809,290 issued May 7, 1974. However, such pouch piercing device requires the use of special rigid tubular member which is lodged within the confines of the pouch and used to perforate and seal the pouch to the pouring spout of the rigid container. It will be easily understood that the insertion of an additional element within the confines of the pouch is an additional operation which adds to the cost of making and packaging the pouches.

It is therefore the object of the present invention to provide a liquid containing and dispensing device equipped with a liquid dispensing means which can easily perforate the pouch and form a pouring spout for the liquid contained in the pouch.

The liquid containing and dispensing device, in accordance with the invention, comprises a rigid wall container adapted to receive a sealed liquid containing pouch having flexible walls in close contact with the walls of the container and a pouring spout having a tubular depending portion with a sharpened end movably mounted on the container and adapted to perforate the top of the pouch and form a seal around the opening in the pouch to effect pouring of the contents of the pouch.

The pouring spout preferably includes two rust proof wires and the container includes two wire guiding means one on each side thereof for permitting the wires to slide down along the container.

In a preferred embodiment of the invention, the guiding means include a hole in the upper edge of the container and an open guide lined up with said hole along the side of the container. Each guide is provided with a cut-away portion which permits tilting of the wires when the pouring spout is in a raised position to move the pouring spout out of the way for insertion of a new pouch in the container.

The depending portion of the pouring spout is preferably a tube having a bevelled end edge and is slightly flatened longitudinally of the tube to form a pointed tip; the end edge is sharpened only partially around the end edge so as to cut a hole in the pouch of a size smaller than the cross-sectional area of the tube whereby the wall of the pouch will be stretched around the tubular piercing element and from a seal around it to prevent escape of the contents of the pouch around the tubular piercing element.

The invention will now be disclosed, by way of example, with reference to a preferred embodiment illustrated in the accompanying drawings in which.

Figures 2, 3, 4, 5:
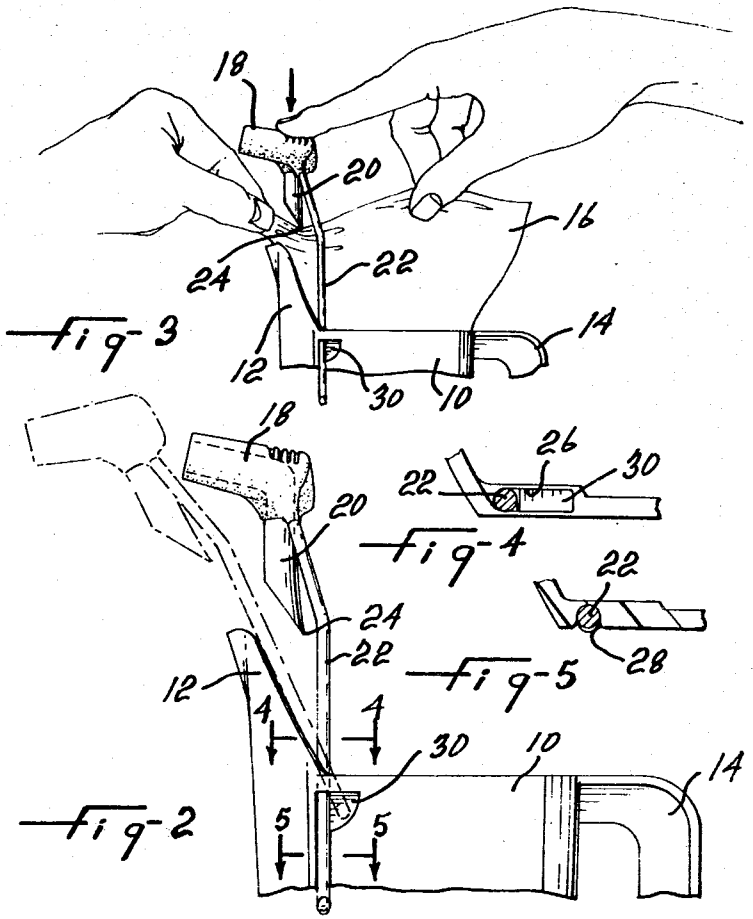
FIG. 2 illustrates a partial side view of the liquid containing and dispensing device of FIG. 1 to show how the pouring spout may be moved away to permit insertion of a new pouch in the liquid containing and dispensing device.
FIG. 3 illustrates how the pouring spout is operated for perforating the pouch.
FIG. 4 illustrates a view taken along line 4—4 of FIG. 2.
FIG. 5 illustrates a view taken along line 5—5 of FIG. 2.
Figure 1:
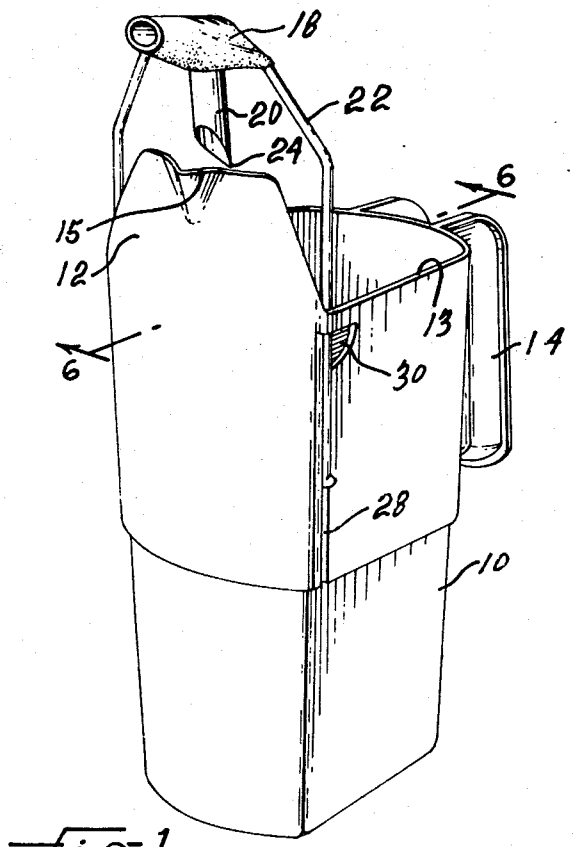
FIG. 1 illustrates a perspective view of a liquid containing and dispensing device in accordance with the invention.

Referring to the drawings, there is shown a rigid wall container 10 having rigid side walls forming a pouring head 12 and supporting a handle 14 at the back. Pouring head 12 forms a front wall protruding upwardly from the top edge 13 of the side and back walls of the container 10, and head 12 has a pouring lip 15. The container is adapted to receive a liquid containing pouch 16 of predetermined size. The pouch has flexible walls generally made of liquid proof plastic material which closely fit the inside walls of the rigid container.

A pouring spout 18 having a depending tubular portion 20 attached thereto is integrally molded with the end of two supporting rust proof wires 22 which are slidably mounted on the container.

As shown in FIGS. 1–5, the wires are inserted into guiding means including holes 26 in the upper edge of the container and adapted to slide in open guides 28 along the side of the container. Each guide 28 is provided with a cut-away portion 30, adjacent hole 26, which permits tilting of the wires when the pouring spout is pulled up as shown in FIG. 2 to move the pouring spout out of the way and prevent accidental piercing of the pouch during insertion of a new pouch in the container.

Figure 7:
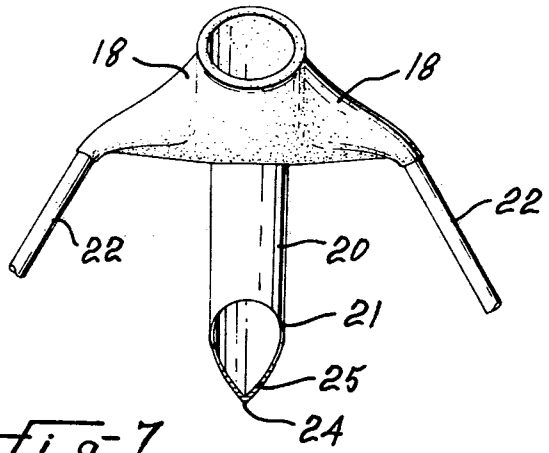
FIG. 7 illustrates a side view of the pouring element of the liquid containing and dispensing device illustrating how the pointed end of the tubular depending portion of the pouring spout is formed.
Figure 8:
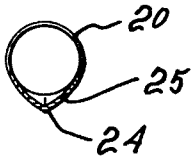
FIG. 8 illustrates an end view of the depending portion of the pouring spout of FIG. 7.
Figure 6:
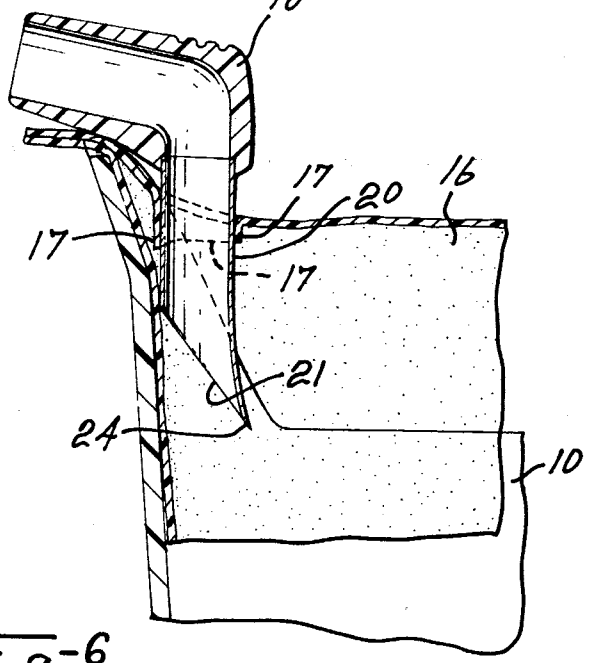
FIG. 6 illustrates a view taken along line 6—6 of FIG. 1.

Referring to FIGS. 6–8, it will be seen that the pouch piercing tubular depending element 20 has a bevelled end edge 21 and is partly flatened longitudinally of element 20 to form a pointed tip 24. Only the end edge portion 25 illustrated by shading in FIGS. 7 and 8, and including tip 24, is sharpened so as to cut a hole of minimum size in the pouch whereby the wall of the pouch will be stretched around the tubular piercing element and form a fold 17 (see FIG. 6) in firm contact with and around element 20 constituting a seal to prevent escape of the contents of the pouch around the tubular element.

When it is desired to replace an empty pouch, the pouring spout is raised to its upper position and pushed sideways to tilt the pouring spout as shown in FIG. 2 of the drawings. A new pouch is placed in the container and pouring spout is brought back in upright position. The top of the pouch is stretched over pouring head 12 and spout 18 is pressed down as shown in FIG. 3 to pierce a hole through the top of the pouch without piercing the side wall of the pouch. When the pouring spout is down in contact with the pouring head of the container, as shown in FIG. 6, the tubular piercing element is within the confines of the spout and a tight seal is formed around the depending portion of the pouring spout so that no liquid leak around the spout will occur.

Pouring spout 18 together with wires 22 may be removed from container 10 for easier cleaning and for use of container as conventional pitcher.

Because tubular piercing element 20 is located close to the inner surface of pouring head 12, in its operative position, practically all of the liquid content of the pouch can be dispensed.

Although the invention has been disclosed with reference to a preferred embodiment, it is to be understood that the invention is not limited to such embodiment and that other alternatives are also envisaged. For example, other means of mounting the pouring spout on the container could be used. Other means for guiding the pouring spout or for permitting tilting thereof for replacement of an empty pouch by another one are also envisaged.

What I claim is:

1. A liquid containing and dispensing device comprising:

(a) a rigid wall container adapted to receive a sealed liquid containing pouch having flexible walls in close contact with the walls of said container; and (b) a pouring spout having a tubular depending portion with a sharpened end movably mounted at the top of said container and adapted to perforate the top of said pouch and form a seal around the opening of the pouch to effect pouring of the contents of the pouch, said pouring spout including two rust-proof wires and said container including two wire guiding means, one on each side thereof, permitting said wires to slide down along the sides of the container.

2. A liquid containing and dispensing device as defined in claim 1, wherein said guiding means include a hole in the upper edge of the container, an open guide in line with said hole and a cut-away portion on one side of said open guide for permitting tilting of the wires supporting the pouring spout to permit insertion of a pouch into the container.

3. A liquid containing and dispensing device as defined in claims 1, or 2, wherein said tubular depending portion is a tube which has a bevelled end edge and which is partly flattened longitudinally of the tube to form a pointed tip, said end edge being sharpened only partially around the same, so as to cut a hole in a pouch of a size smaller than the cross-sectional area of the tube, whereby the wall of said pouch will be stretched around the tubular depending portion of the pouring spout and form a seal around it to prevent escape of the contents of said pouch around the tubular depending portion.

4. A liquid containing and dispensing device comprising:

(a) a rigid wall container adapted to receive a sealed liquid containing pouch having flexible walls in close contact with the walls of said container; and (b) a pouring spout having a tubular depending portion with a sharpened end movably mounted at the top of said container and adapted to perforate the top of said pouch and form a seal around the opening of the pouch to effect pouring of the contents of the pouch, said tubular depending portion being a tube which has a bevelled end edge and which is partially flattened longitudinally of the tube to form a pointed tip, said end edge being sharpened only partially around the same, so as to cut a hole in a pouch of a size smaller than the cross-sectional area of the tube, whereby the wall of said pouch will be stretched around the tubular depending portion of the pouring spout and form a seal around it to prevent escape of the contents of said pouch around the tubular depending portion.

* * * * *